US011351433B1

(12) United States Patent
Krug

(10) Patent No.: US 11,351,433 B1
(45) Date of Patent: Jun. 7, 2022

(54) MOUNTAIN CLIMBING TRAINING APPARATUS

(71) Applicant: Dan Krug, Denver, CO (US)

(72) Inventor: Dan Krug, Denver, CO (US)

( * ) Notice: Subject to any disclaimer, the term of this patent is extended or adjusted under 35 U.S.C. 154(b) by 0 days.

(21) Appl. No.: 17/540,952

(22) Filed: Dec. 2, 2021

Related U.S. Application Data

(60) Provisional application No. 63/145,252, filed on Feb. 3, 2021, provisional application No. 63/128,450, filed on Dec. 21, 2020.

(51) Int. Cl.
*A63B 69/00* (2006.01)

(52) U.S. Cl.
CPC ..... *A63B 69/0048* (2013.01); *A63B 2209/08* (2013.01); *A63B 2209/10* (2013.01)

(58) Field of Classification Search
CPC ..... A63B 69/0048
See application file for complete search history.

(56) References Cited

U.S. PATENT DOCUMENTS 2,977,082 A * 3/1961 Harris ..... A47G 1/17 402/503
3,023,991 A 3/1962 Fisher
3,408,771 A 11/1968 Garrett et al.
5,201,486 A 4/1993 Holbrook
6,425,560 B1 7/2002 Dembowiak et al.
7,699,277 B2 * 4/2010 Bagnall ..... F16L 3/13 119/245
7,887,109 B2 * 2/2011 Liao ..... B66C 1/0225 294/187
10,625,411 B2 * 4/2020 Tesoroni ..... F16B 2/22
2007/0107665 A1 * 5/2007 Enoch ..... A01K 63/10 119/264
2007/0164182 A1 * 7/2007 MacKay ..... A63B 69/0048 248/300
2008/0185221 A1 * 8/2008 Postma ..... A63B 69/0048 700/80
2009/0200441 A1 8/2009 Kuhn et al.
2009/0211533 A1 * 8/2009 Sprung ..... B24D 15/00 51/297
2009/0277940 A1 * 11/2009 Cook ..... A63B 57/20 206/315.9
2010/0163696 A1 7/2010 Briggs et al.
2012/0115629 A1 * 5/2012 McDowell ..... A63B 55/10 473/286
2012/0148991 A1 * 6/2012 Coutlee ..... A63H 33/26 434/247
2014/0103169 A1 4/2014 Heard et al.
(Continued)

OTHER PUBLICATIONS

Johnny Catch Magnet Bottle Opener "https://www.greatbartender.com/product/johnny-catch-magnet-bottle-opener/" Oct. 27, 2020 (Year: 2020).*

(Continued)

*Primary Examiner* — Nyca T Nguyen
(74) *Attorney, Agent, or Firm* — Hall Estill Law Firm

(57) ABSTRACT

A training apparatus for mountain climbers. The training apparatus includes a base portion and a ring member. The ring member extends substantially perpendicular from the base portion. The training apparatus can also include an attachment mechanism secured to the base portion for securing the training apparatus to a surface.

15 Claims, 5 Drawing Sheets

(56) References Cited

U.S. PATENT DOCUMENTS

| | | | | |
|---|---|---|---|---|
| 2014/0263894 | A1* | 9/2014 | Chen | F16B 47/003 248/205.8 |
| 2014/0356077 | A1 | 12/2014 | Kekahuna et al. | |
| 2015/0099613 | A1* | 4/2015 | Munoz Saez | A63B 21/16 482/139 |
| 2017/0138533 | A1 | 5/2017 | Maurice et al. | |
| 2017/0296877 | A1* | 10/2017 | Bennett | A63B 69/0048 |
| 2017/0354847 | A1* | 12/2017 | Carter | A63B 27/00 |
| 2018/0126218 | A1* | 5/2018 | Curry | A63B 21/0552 |
| 2019/0009157 | A1* | 1/2019 | Sudeith | A63B 21/068 |
| 2019/0247714 | A1* | 8/2019 | Curry | A63B 23/16 |
| 2019/0381359 | A1* | 12/2019 | Polig | G01P 15/02 |
| 2020/0094102 | A1* | 3/2020 | McRann | A63B 23/1236 |
| 2020/0114239 | A1* | 4/2020 | Canfield | A63B 71/0054 |
| 2020/0376343 | A1* | 12/2020 | Dickenson | A62B 35/0043 |
| 2021/0106895 | A1* | 4/2021 | Gopalakrishnan | A63B 71/023 |
| 2021/0116066 | A1* | 4/2021 | Tsui | F16M 11/2021 |
| 2021/0285824 | A1* | 9/2021 | Sanders | G01K 1/143 |

OTHER PUBLICATIONS

PCT/US2021/061632; "International Search Report and Written Opinion"; dated Feb. 14, 2022; 11 pages.

* cited by examiner

MOUNTAIN CLIMBING TRAINING APPARATUS

STATEMENT REGARDING FEDERALLY SPONSORED RESEARCH OR DEVELOPMENT

Not applicable.

CROSS-REFERENCE TO RELATED APPLICATIONS

The present application is a conversion of U.S. Provisional Application No. 63/128,450, filed Dec. 21, 2020, and U.S. Provisional Application No. 63/145,252, filed Feb. 3, 2021, which claims the benefit under 35 U.S.C. 119(e). The disclosures of which are hereby expressly incorporated herein by reference.

BACKGROUND OF THE DISCLOSURE

1. Field of the Invention

The present disclosure relates to a mountain climbing training apparatus for selective attachment to metal surfaces to provide a simulation for a key aspect of mountain climbing.

2. Description of the Related Art

Typically, during mountain climbing a hole is drilled into the side of the mountain and a hanger is bolted to the side of the mountain with an anchor bolt. The firmly secured hanger provides an attachment point for various mountain climbing gear. Dealing with the hanger during climbing operations has to be precise or serious injury, or even death, could occur.

Accordingly, there is a need for an apparatus that can be used to train a climber how to perform the climbing functions involving the hanger in a setting where the consequences for an error are not so unforgiving.

SUMMARY OF THE DISCLOSURE

The present disclosure is directed to a training apparatus for mountain climbers. The training apparatus includes a base portion and a ring member. The ring member extends substantially perpendicular from the base portion. The training apparatus can also include an attachment mechanism secured to the base portion for securing the training apparatus to a surface.

DETAILED DESCRIPTION OF THE DISCLOSURE

Figure 1:
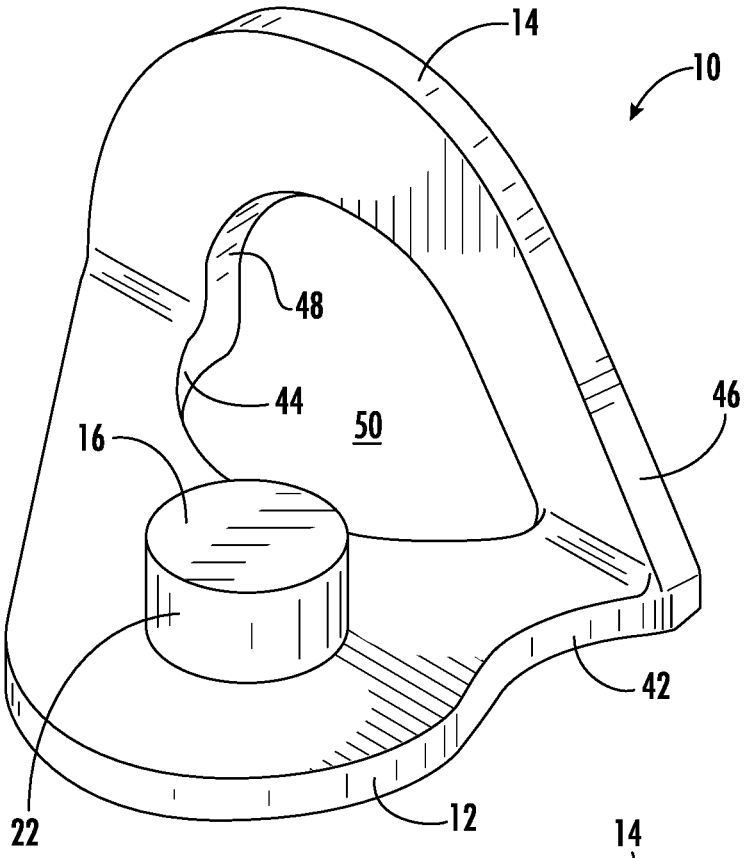
FIG. 1 is a perspective view of a mountain climbing training apparatus constructed in accordance with the present disclosure.
Figure 2:
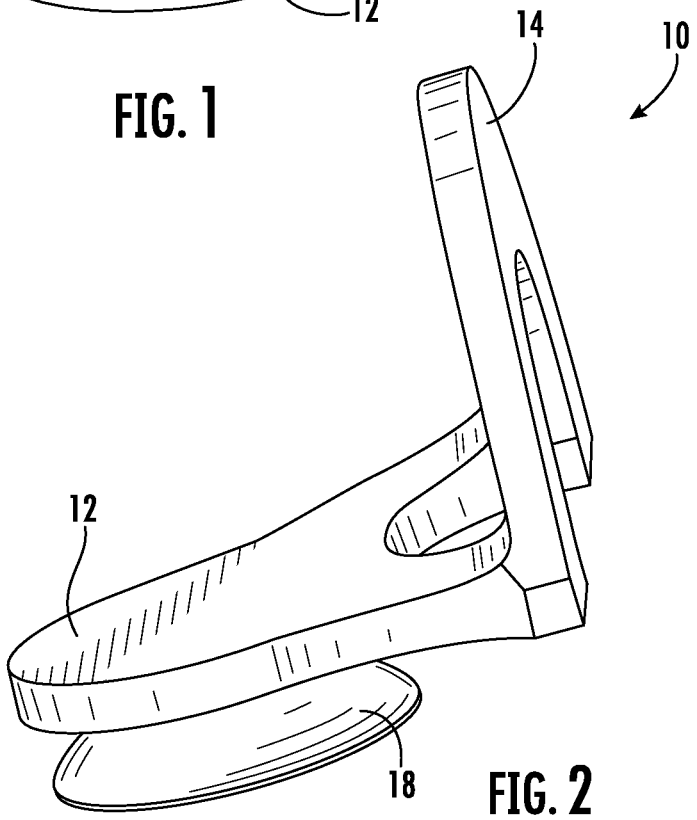
FIG. 2 is a perspective view of another embodiment of the mountain climbing training apparatus constructed in accordance with the present disclosure.
Figure 3:
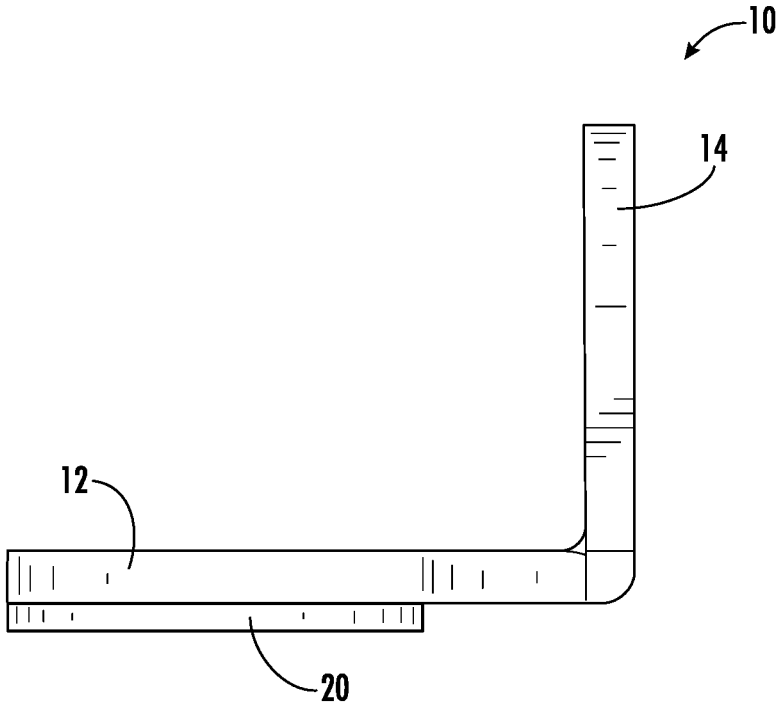
FIG. 3 is a side elevation view of yet another embodiment of the mountain climbing training apparatus constructed in accordance with the present disclosure.
Figure 4:
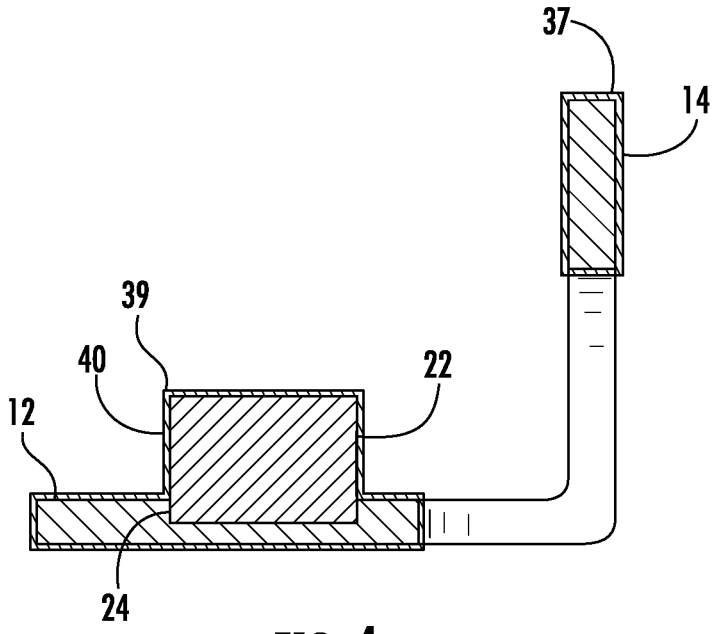
FIG. 4 is a cross-sectional view of a further embodiment of the mountain climbing training apparatus constructed in accordance with the present disclosure.
Figure 5:
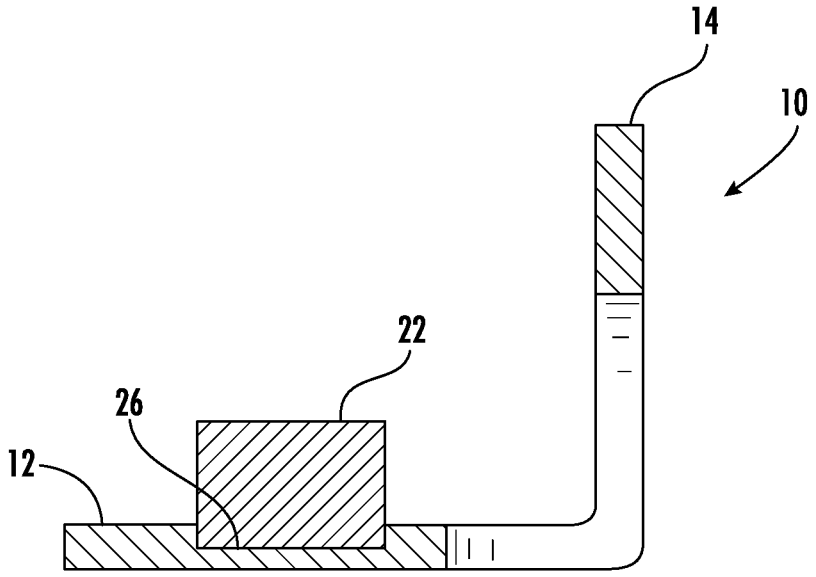
FIG. 5 is a cross-sectional view of a further embodiment of the mountain climbing training apparatus constructed in accordance with the present disclosure.
Figure 6:
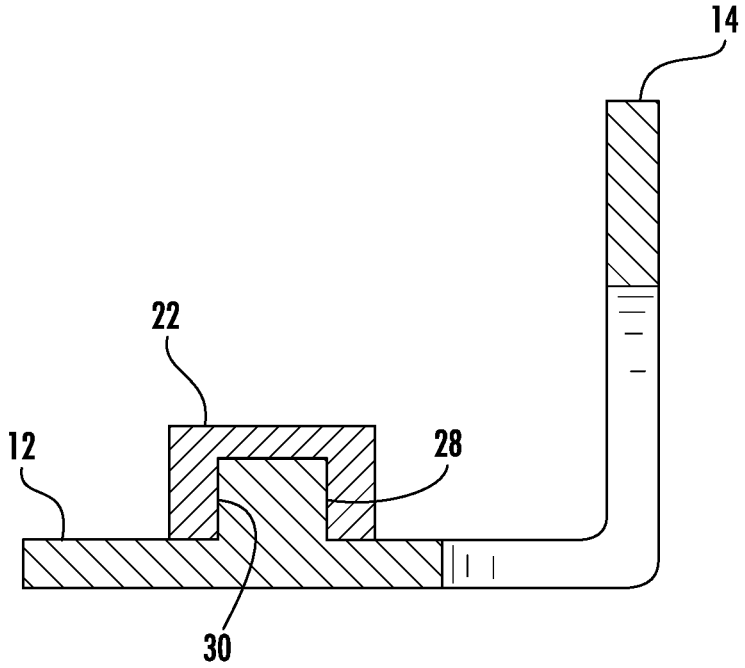
FIG. 6 is a cross-sectional view of a further embodiment of the mountain climbing training apparatus constructed in accordance with the present disclosure.
Figure 7:
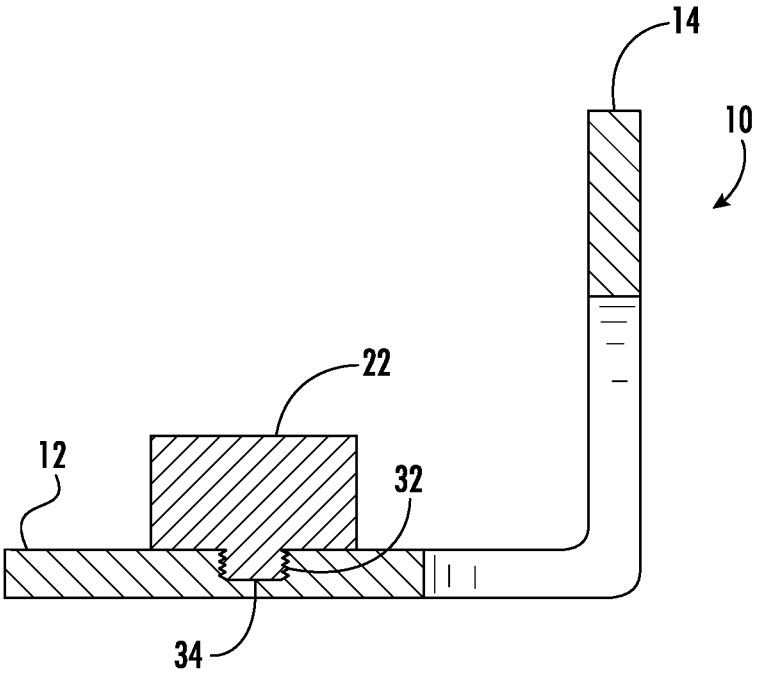
FIG. 7 is a cross-sectional view of a further embodiment of the mountain climbing training apparatus constructed in accordance with the present disclosure.
Figure 8:
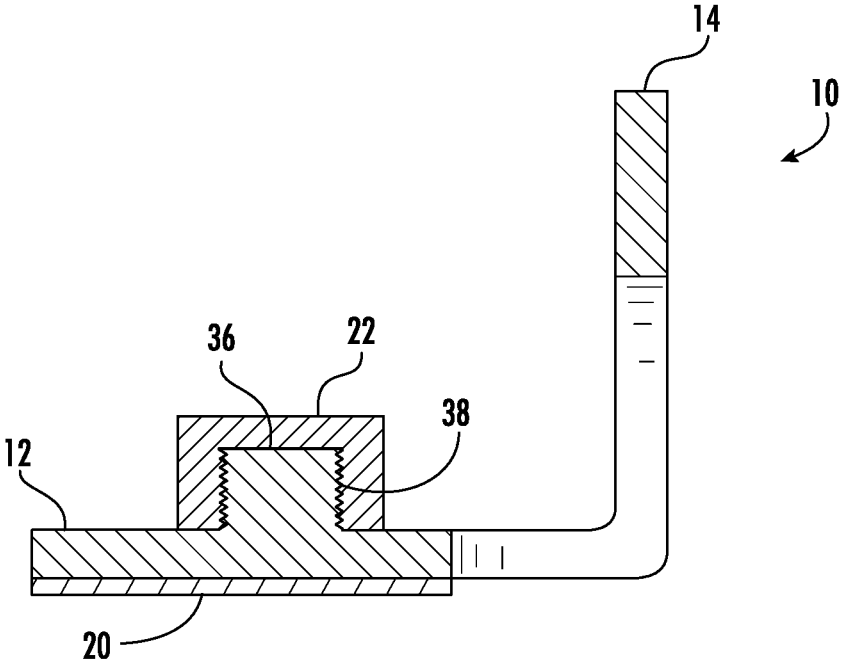
FIG. 8 is a cross-sectional view of a further embodiment of the mountain climbing training apparatus constructed in accordance with the present disclosure.
Figure 9B:
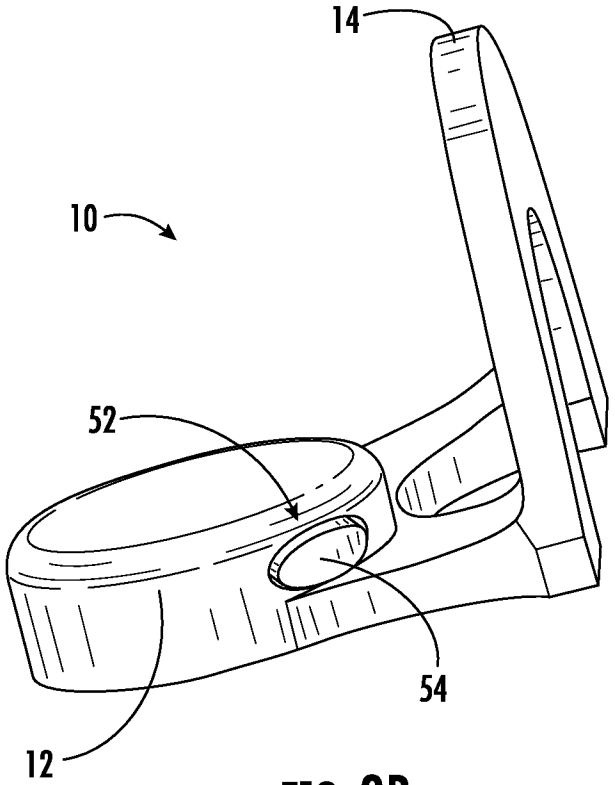
FIGS. 9A and 9B is a perspective views of a further embodiment of the mountain climbing training apparatus constructed in accordance with the present disclosure.
Figure 9A:
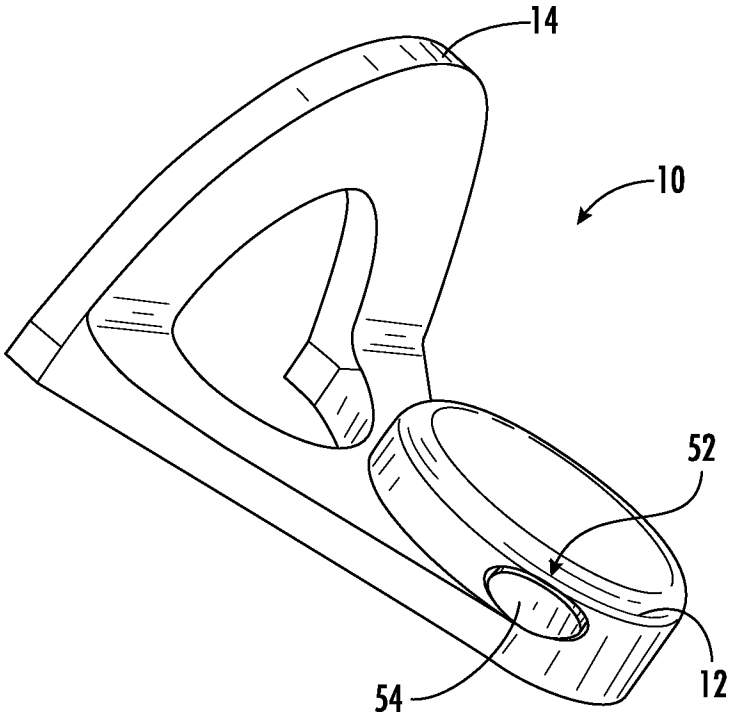

The present disclosure relates to a mountain climbing training apparatus 10 that can be removably attached to a particular surface to provide a mountain climber with an apparatus that can be used to practice certain vital aspects of mountain climbing at a safe location. The training apparatus 10 includes a base portion 12 and a partial ring member 14 (or curved member) that extends from the base portion 12. The ring member 14 provides the climber with the part the climber interacts with to practice the operations the climber would undertake on the side of a mountain. The base portion 12 can include an attachment mechanism 16 to permit the training apparatus 10 to be secured to various objects where a climber can stand on the ground at a convenient location, such as their house, garage, workplace, etc., and practice the certain climbing operations with the training apparatus 10.

The attachment mechanism 16 can be any type of attachment means known in the art capable of adhering the training apparatus 10 to a particular surface. For example, the attachment mechanism 16 could be a suction apparatus 18, such as a suction cup, that can be locked on. The attachment mechanism 16 could be an adhesive layer 20 attached to the base portion. In one embodiment, the attachment mechanism 16 is a magnet element 22. The magnet element 22 can be selectively secured to the base portion 12 so that different strength magnet elements 22 could be used depending on the equipment that might be used by the climber when training with the training apparatus 10. The magnet element 22 can be selectively securable to the base portion 12 by any means known in the art. The magnet element 22 could have a protrusion element 24 that can be inserted into a depression area 26 of the base portion 12. Alternatively, the base portion 12 could have a protrusion element 28 attached thereto and can engage a depression area 30 disposed in the magnet element 22. The magnet elements 22 can be glued to the base portion 12 or wedged together and held together via frictional engagement. The magnet element 22 can also just use its magnetic characteristics and stick to the base portion 12 and cause the base portion 12 to stick to a metal surface so the training apparatus 10 can be used for practice. In another example, the base portion 12 could have a threaded hole 32 therein that would permit varying size magnets 22 with a threaded shaft 34 to be secured thereto. Conversely, the base portion 12 of the training apparatus 10 could have the threaded shaft 36 extending therefrom and the varying sized magnets 22 could have the threaded hole 38 that engages the threaded shaft 36 extending from the base portion 12 of the training apparatus 10.

In another embodiment of the present disclosure, the magnet element 22 could be encompassed as part of the base portion 12. For example, the base portion 12 could have the magnet element 22 built therein. In one example, the base portion 12 and the magnet element 22 could be at least partially encapsulated in a polymeric material 39, such as plastic, nylon, rubber and the like. The base portion 12 could be made of any material capable of providing the support necessary for the ring member 14 and allow the training apparatus 10 to be used for its intended purpose. In this embodiment, the magnet element 22 would cause the base portion 12 to have a protruded portion 40 that can simulate a part of the bolt that would anchor a bolt hanger to the side of a mountain. This would contribute to the realism of the training apparatuses and make the use of them more beneficial to the training climber.

In a further embodiment of the present disclosure, the base portion 12 can have a first and second leg portion 42 and 44 that extend out and support a first end 46 of the ring member 14 and a second end 48 of the ring member 14, respectively. In this embodiment, the ring member 14 extends substantially perpendicular from the first and second legs 42 and 44 of the base portion 12. The ring member 14 extending from the first and second legs 42 and 44 creates a space 50 where nothing exists between the ring member 14 and the surface the training apparatus is attached to. This generates an apparatus for training where there are no impediments to engaging the ring member 14 with the various climbing instruments during practice.

In yet another embodiment, the base portion 12 can include a pinch grip 52 disposed thereon to facilitate the removal of the training apparatus 10 from whatever surface it is secured to. The pinch grip 52 can be made of a material that is more grippable by the user of the training apparatus 10 than the material the base portion 12 is made of. For example, the base portion 12 may be made of nylon or plastic and the pinch grip 52 can be made of rubber. Furthermore, the pinch grip 52 may be comprised of two portions 54 that extend from the base portion 12 some amount to make it easier for the user to engage them and remove the training apparatus 10 from whatever surface it has been adhered to.

In a further embodiment of the present disclosure, the training apparatus 10 could have two separate attachment mechanisms 16. For example, the base portion 12 of the training apparatus 10 could include an adhesive layer 20 that is removably adhesive to the base portion 12 and the magnet element 22 discussed herein. The adhesive layer 20 can be a sticky gel. The adhesive layer 20 being removable adhesive limits the adhesiveness to a level where the training apparatus 10 can be removed from the surface it was placed on without tearing up the adhesion layer 20 or the surface it was placed on and put on a different surface and maintain sufficient stickiness to perform as intended.

When a magnet 22 only is used, it can require a fairly large magnet to be used to prevent any lateral movement of the training apparatus 10 on the surface the training apparatus 10 is placed on. A stronger magnet can make the training apparatus 10 bigger and bulkier. However, if a smaller magnet 22 is used, the training apparatus 10 is sleeker, but lateral movement of the training apparatus 10 occurs more easily. Depending on the metallic surface the training apparatus 10 is placed on, lateral movement might cause unwanted scratching of the surface. For example, if the training apparatus 10 was placed on a stainless steel kitchen appliance, such as a refrigerator, the surface could easily be scratched and the desire is to avoid this. So, in addition to the magnet element 22, the adhesive layer 20 can be applied to the base portion 12 of the training apparatus 10 to prevent lateral movement of the training apparatus 10 when a smaller, less magnetized magnet is used.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A training apparatus for mountain climbers, the training apparatus comprising:
- a base portion;
- a ring member extending substantially perpendicular from the base portion;
- a primary attachment mechanism secured to the base portion for securing the training apparatus to a surface, the primary attachment mechanism is a magnet element; and
- a threaded shaft extending from the base portion to engage with a threaded hole in the magnet element.

2. The training apparatus of claim 1 wherein the base portion includes a first leg portion and a second leg portion extending therefrom.

3. The training apparatus of claim 2 wherein the first leg portion includes a first leg extending perpendicular therefrom and the second leg portion includes a second leg extending perpendicular therefrom.

4. The training apparatus of claim 3 wherein the ring member extends from the first leg to the second leg.

5. The training apparatus of claim 1 further comprising a secondary attachment mechanism.

6. The training apparatus of claim 5 wherein secondary attachment mechanism is an adhesive layer disposed on the base portion.

7. The training apparatus of claim 1 wherein the magnet element and base portion are at least partially covered with a polymeric material.

8. The training apparatus of claim 7 wherein the polymeric material is selected from the group consisting of plastic, rubber and nylon.

9. A training apparatus for mountain climbers, the training apparatus comprising:
- a base portion;
- a ring member extending substantially perpendicular from the base portion;
- an attachment mechanism secured to the base portion for securing the training apparatus to a surface; and
- a pinch grip located on the base portion to facilitate removal of the training apparatus from the surface the training apparatus has been placed on.

10. The training apparatus of claim 9 wherein the attachment mechanism is a magnet element.

11. The training apparatus of claim 10 wherein the magnet element and the base portion are at least partially covered with a polymeric material.

12. The training apparatus of claim 10 wherein the training apparatus further includes an adhesive layer disposed on the base portion.

13. The training apparatus of claim 9 wherein the attachment mechanism is a suction cup attached to the base portion.

14. The training apparatus of claim 9 wherein attachment mechanism is an adhesive layer disposed on the base portion.

15. The training apparatus of claim 9 wherein the pinch grip comprises a first and a second extended portion that extend from the base portion.

* * * * *